US012454394B2

(12) United States Patent
Struthers et al.

(10) Patent No.: US 12,454,394 B2
(45) Date of Patent: Oct. 28, 2025

(54) APPLICATOR CAP FOR DISPENSING TOPICAL PRODUCTS

(71) Applicant: CHATTEM, INC., Bridgewater, NJ (US)

(72) Inventors: Ken Struthers, Bridgewater, NJ (US); David Sharp, Bridgewater, NJ (US)

(73) Assignee: Chattem, Inc., Bridgewater, NJ (US)

( * ) Notice: Subject to any disclaimer, the term of this patent is extended or adjusted under 35 U.S.C. 154(b) by 0 days.

(21) Appl. No.: 18/684,748

(22) PCT Filed: Aug. 20, 2021

(86) PCT No.: PCT/US2021/046963

§ 371 (c)(1),
(2) Date: Feb. 19, 2024

(87) PCT Pub. No.: WO2023/022734

PCT Pub. Date: Feb. 23, 2023

(65) Prior Publication Data

US 2024/0367870 A1 Nov. 7, 2024

(51) Int. Cl.
*B65D 47/06* (2006.01)
*A45D 34/04* (2006.01)
(Continued)

(52) U.S. Cl.
CPC ..... *B65D 47/06* (2013.01); *A45D 34/04* (2013.01); *B65D 50/04* (2013.01); *B65D 51/18* (2013.01); *A45D 2200/10* (2013.01)

(58) Field of Classification Search
CPC .... A45D 34/04; A45D 34/041; A45D 34/042; A45D 40/26; A45D 40/261; A45D 40/262; A61H 7/005; B65D 35/36; B65D 47/28
See application file for complete search history.

(56) References Cited

U.S. PATENT DOCUMENTS 1,913,462 A 6/1933 Timar
2,285,105 A 6/1942 Bacher
(Continued)

FOREIGN PATENT DOCUMENTS

CA 3123211 A1 12/2021
CH 717560 A2 12/2021
(Continued)

OTHER PUBLICATIONS

International Search Report & Written Opinion issued in PCT/US2021/046963, mailed Dec. 17, 2021 [8 pages].
(Continued)

*Primary Examiner* — Jennifer C Chiang
(74) *Attorney, Agent, or Firm* — Ice Miller LLP

(57) ABSTRACT

An applicator cap and containers for dispensing and applying a topical product, such as a lotion, cream, medicine, or liquid are disclosed. The applicator cap and containers have a top section, a base section, and an optional cap for the top section. The top section can include an upper face and at least two elongated sections extending downward from the upper face. The upper face further includes a plurality of raised nubs around a central opening for dispensing the product. The base section is connected to the top section via corresponding coupling elements, and the base section is slidably movable relative to the top section. In an open position, the cylindrical tube and the central opening form a pathway for dispersion of the product. In a closed position, the cylindrical tube and central opening form a seal to prevent dispersion of the product.

20 Claims, 8 Drawing Sheets

(51) Int. Cl.
*B65D 50/04* (2006.01)
*B65D 51/18* (2006.01)

(56) References Cited

U.S. PATENT DOCUMENTS

| | | | |
|---|---|---|---|
| 2,480,023 | A | 8/1949 | Holden |
| D272,235 | S | 1/1984 | Orlando |
| D277,825 | S | 3/1985 | Whatley |
| 5,131,384 | A | 7/1992 | Obagi |
| 5,908,256 | A | 6/1999 | Bernstein |
| D426,301 | S | 6/2000 | Stromblad |
| D426,885 | S | 6/2000 | Stromblad |
| D428,142 | S | 7/2000 | Stromblad |
| D432,648 | S | 10/2000 | Stromblad |
| 6,129,469 | A | 10/2000 | Messer et al. |
| D450,153 | S | 11/2001 | Knieriemen |
| D518,915 | S | 4/2006 | Angeletta |
| D555,831 | S | 11/2007 | Chan |
| 7,618,207 | B2 | 11/2009 | Thiebaut |
| D608,097 | S | 1/2010 | Zanjani |
| 8,074,821 | B2 | 12/2011 | Yeager |
| D654,792 | S | 2/2012 | Bertelsen |
| D725,489 | S | 3/2015 | Sutcliffe |
| D744,857 | S | 12/2015 | Gieske et al. |
| 9,387,965 | B2 | 7/2016 | Skillin et al. |
| 10,016,044 | B2 | 7/2018 | Debnath et al. |
| D827,433 | S | 9/2018 | Bickford et al. |
| D827,434 | S | 9/2018 | Bickford et al. |
| 10,085,548 | B2 | 10/2018 | Jimenez et al. |
| 10,136,718 | B2 | 11/2018 | Zembrod |
| D858,282 | S | 9/2019 | Han |
| 10,555,592 | B2 | 2/2020 | Dandiker et al. |
| D931,101 | S | 9/2021 | Tse et al. |
| 11,185,672 | B2 | 11/2021 | Tharp et al. |
| D968,222 | S | 11/2022 | Sabherwal et al. |
| D1,010,470 | S | 1/2024 | Wu |
| D1,021,419 | S | 4/2024 | Wu |
| D1,027,169 | S | 5/2024 | Sabherwal et al. |
| D1,038,513 | S | 8/2024 | Lu |
| 12,059,066 | B2 * | 8/2024 | Greiner-Perth ..... B05B 11/04 |
| 2005/0199655 | A1 | 9/2005 | Petit |
| 2007/0205233 | A1 | 9/2007 | Petit et al. |
| 2009/0270832 | A1 | 10/2009 | Vancaillie et al. |
| 2012/0282010 | A1 * | 11/2012 | Albers ..... A46B 11/0041 220/259.3 |
| 2014/0323993 | A1 | 10/2014 | Wilcox et al. |
| 2014/0371690 | A1 | 12/2014 | Sprada et al. |
| 2019/0166976 | A1 | 6/2019 | Croix |
| 2021/0403210 | A1 | 12/2021 | Bohlen et al. |
| 2022/0176094 | A1 | 6/2022 | Tharp et al. |
| 2022/0265550 | A1 | 8/2022 | Sabherwal et al. |
| 2022/0265979 | A1 | 8/2022 | Sabherwal et al. |
| 2024/0299296 | A1 | 9/2024 | Sabherwal et al. |

FOREIGN PATENT DOCUMENTS

| | | | |
|---|---|---|---|
| CN | 103171819 | B | 11/2015 |
| CN | 106511050 | B | 8/2023 |
| EP | 2986530 | B1 | 9/2018 |
| EP | 3165125 | B1 | 7/2019 |
| EP | 3597072 | A1 * | 1/2020 ..... A45D 34/04 |
| FR | 2866819 | B1 | 3/2006 |
| GB | 2519206 | B | 11/2015 |
| JP | 2006075607 | A | 3/2006 |
| JP | 6671734 | B2 | 3/2020 |
| RU | 2599863 | C2 | 10/2016 |
| WO | 2014170841 | A2 | 10/2014 |
| WO | 2016000054 | A1 | 1/2016 |
| WO | 2022180064 | A1 | 9/2022 |

OTHER PUBLICATIONS

Design U.S. Appl. No. 29/804,560, filed Aug. 20, 2021 [14 pages].

* cited by examiner

APPLICATOR CAP FOR DISPENSING TOPICAL PRODUCTS

CROSS-REFERENCE TO RELATED APPLICATIONS

This application is a National Stage of International Patent Application No. PCT/US2021/046963, filed on Aug. 20, 2021, the disclosure of which is incorporated by reference in its entirety.

TECHNICAL FIELD

The present invention relates to an applicator cap, and in particular to a cap for dispensing and applying products such as topical creams, ointments, and medicines.

BACKGROUND

Topical products, such as creams, lotion, ointments and medicines are often packaged in a tube, and dispensed through an opening beneath a removable cap. Upon dispensing the product, e.g., by squeezing the tube, users must manually spread and apply the product to the intended area. Manual application can be undesirable, especially when the product's texture, composition and/or consistency is difficult to clean or remove. Products containing strong or odorous chemical compounds can make manual application particularly undesirable. In addition, many traditional devices require a low viscosity product for effective use, and have difficulty dispensing and applying high viscosity creams and ointments. Current devices and application methods can also be wasteful, as excess product can be left on the user's hands and/or an applicator device. Over time, wasting product can become costly. Accordingly, there exists a need for improved devices and methods to address the challenges of topical product dispensing and application.

SUMMARY

The present invention relates to an applicator cap usable for dispensing and applying a product, such as a topical product, e.g., a cream, medicine, ointment, etc. Embodiments of the present invention include a top section and base section that are slidably attached to move between an open position and a closed position.

The top section can include an upper face and at least two elongated sections extending downward from the upper face, wherein the upper face includes a plurality of raised nubs around a central opening for dispensing the product, and the at least two elongated sections include a raised coupling element on an internal face. The base section connects to the top portion via corresponding coupling elements secured to the raised coupling element on the at least two elongated sections of the top section. The base section includes an internal thread to attach to a container containing the product, and a cylindrical tube to receive the product from the container. In the open position, the cylindrical tube and the central opening form a pathway for dispersion of the product, and in the closed position, the cylindrical tube and central opening form a seal to prevent dispersion of the product.

In embodiments, the top section can be slidably movable between the open position and the closed position when inward pressure is applied to the at least two elongated sections. A top surface of the top section can include at least fifty raised nubs. In some embodiments, the top includes fifty-four raised nubs. An external face of the top section can include at least one of a plurality of indentations and a set of raised ribs. Such indentations and ribs can be placed between each of the at least two elongated sections and used to promote grip and ease of use. A plurality of ridges can also be present on an external face of the base section.

The wide surface area applicator allows products, e.g., cream and liquid products, to be easily applied, mess-free. The product can be stored in a container, such as a tube, a cylinder, and/or a squeezable container. Some embodiments can further include a cap removably connected to the top portion and configured to seal the upper face.

BRIEF DESCRIPTION OF THE DRAWINGS

The details of particular implementations are set forth in the accompanying drawings and description below. Like reference numerals may refer to like elements throughout the specification. Other features will be apparent from the following description, including the drawings and claims. The drawings, though, are for the purposes of illustration and description only and are not intended as a definition of the limits of the disclosure.

DETAILED DESCRIPTION OF ILLUSTRATIVE EMBODIMENTS

The present invention relates to an applicator cap usable to dispense topical products, such as creams, ointments, and medicinal products. In embodiments, product can be dispensed through an opening in the top portion comprising a plurality of raised nubs, which can assist with product application. Accordingly, the present invention enables users to apply and rub in product without getting the product on their hands, another device, or other area not intended for product application.

Figure 1B:
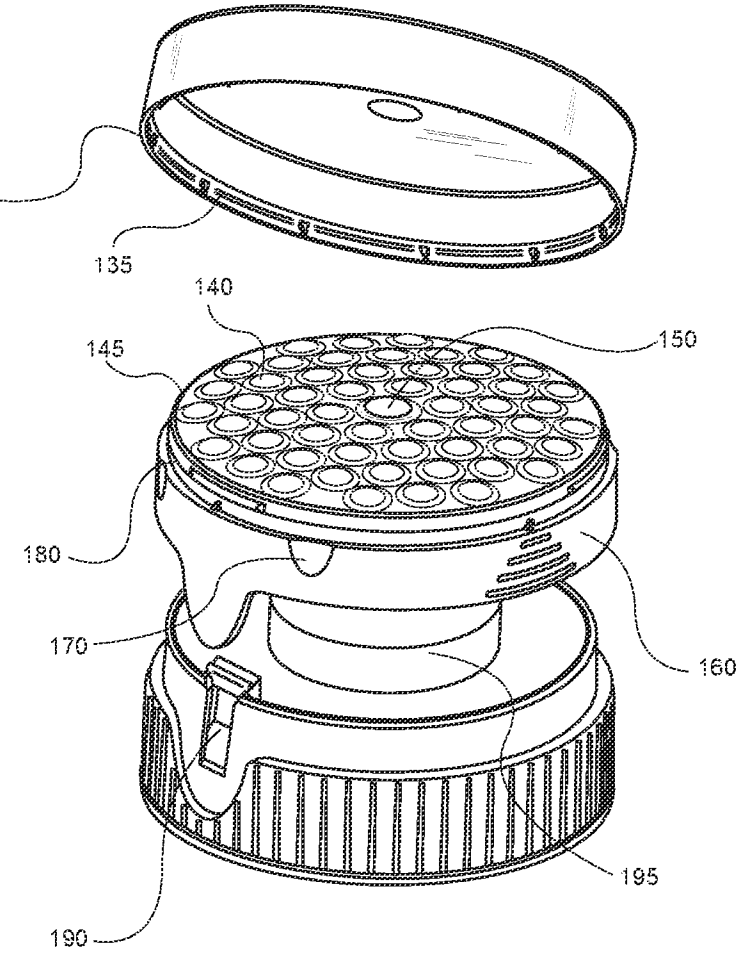
FIG. 1B illustrates an exploded view of an applicator cap in an open position, in accordance with embodiments discussed herein.
Figure 1A:
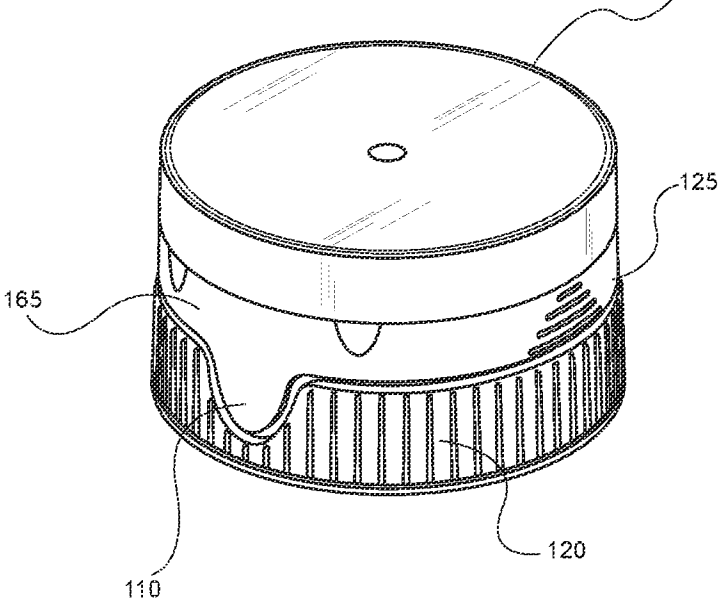
FIG. 1A illustrates an applicator cap in a closed position, in accordance with embodiments discussed herein.

FIGS. 1A-B illustrate an applicator cap. FIG. 1A depicts an applicator cap in a closed position, which prevents dispersion of product through the base section 120 and top section 125 of the applicator. FIG. 1B illustrates an exploded view of an applicator cap. Embodiments can include a base section 120, a top section 125, and an optional cap 130.

The base section 120 can include a cylindrical shape and attach to a container containing a product, such as a topical product, cream, lotion, ointment, liquid, etc. The base section provides an internal pathway 195 for product to be delivered from a container to the top section when the applicator cap is in an open position and prevents product flow through the central opening 150 of the top section when the applicator cap is in the closed position. As discussed herein, the base section can be removably attached to the container. Embodiments can include internal threads to secure to a container, a raised lip, and/or other means to secure the base section to a container. The base section can further include a plurality of ridges along an outer face, e.g., around the circumference of the base section, to improve grip.

The top section includes an upper face 145 and at least two elongated sections 110 extending downward from the upper face. The upper face 145 includes a plurality of raised nubs 140 around a central opening 150. The plurality of raised nubs can be linearly arranged around the central opening and be a height and shape to assist with application of the topical product. The raised nubs can be a circular or rounded shape and include bumps and/or ridges. In various embodiments the upper face can be rounded and form a convex face. The central opening 150) can be positioned at an apex of the upper face.

In examples, product can be dispensed from the container through the central opening 150) and applied to a desired surface, like skin. A user can use the upper face 145 to apply and/or rub in the product through contact with the raised nubs 140. This enables a mess-free application of the product and prevents users from getting the product on their hands, or any other undesired surface when applying the product. The raised nubs further prevent excess product from being left over on surfaces other than the desired surface, or inadvertently applied. In embodiments, the central opening 150 can be sized accordingly to dispense a product at a controlled rate. For example, the central opening can be a circular opening having a 5 mm diameter.

The raised nubs are positioned in a symmetric, circular, and/or linear arrangement to provide maximal application of the product. Embodiments can have a at least, ten, twenty, thirty, forty, or fifty or more raised nubs on the upper face 145. In certain embodiments, 54 raised nubs are provided on the upper face. After product is applied to a desired surface, frictional contact between the plurality of raised nubs and the desired surface enable product to be completely and evenly applied.

The raised nubs can serve as an applicator regardless of whether the applicator cap is in the open or closed position. The closed position forms a seal to prevent any additional product from being delivered through the central opening. The open position allows product to be applied. In the open position, product can be dispensed before, during, after, or without any frictional contact between the desired surface and the plurality of nubs.

As illustrated in FIGS. 1A-B, an optional cap 130 can be removably secured from the top section 125, to at least cover the upper face 145, including the plurality of nubs and central opening 150. In embodiments, the top section can include a raised lip 180 along its circumference that secures to an inner thread 135 of the cap 130. The cap 130 can secure to the top section 125 through any of a variety of manners, depending on design choice, and desired ease of attachment and removal. For example, the cap 130, can snap onto the lip of the top section. In other embodiments, a circumference of the top section can include corresponding threads to an inner portion of the cap 130, to enable the cap to screw onto the top section. In various embodiments, the cap can be a child-proof to prevent unintentional and/or undesired application of the product. The cap 130 can provide an additional level of protection to the upper face and plurality of raised nubs, prevent damage to the upper face, and prevent dirt and debris from accumulating onto the upper face. The cap 130 can further prevent accidental and unintended leakage of the product.

In embodiments, an outer circumferential face 165 of the top section 125 is larger than the circumferential section comprising the raised lip 180 and/or threads for securing the cap 130. In embodiments the circumference of the outer circumferential face 165 and the cap 130 are the same, such that the outer face 165 and the cap 130 are flush when the cap is secured to the top section 125.

The top section 125 can further include one or more indentations 170 and raised portions 160 to assist with manipulation of the device between the open and closed positions. In various embodiments, the one or more indentations 170 and raised portions 160 reside on the outer circumferential face of the top section 125. The indentations 170 and raised portions 160 can be placed at discrete intervals around an external face of the top section. The one or more indentations 170 can help with raising or lowering the top section 125 from the base section 120. The raised portions 160 can be raised lines to promote a secure grip, increase friction, and/or indicate where a user should contact the top section 125 to manipulate the applicator between the open and closed positions.

In various embodiments, the raised portions can include raised horizontal and/or vertical lines. FIG. 1B illustrates a plurality of raised ribs, i.e., horizontal raised lines, on the outer circumferential face 165 of the top section 125. At least two indentations 170 are provided on the outer circumferential face 165. In embodiments, the raised portions 160 and indentations can be evenly spaced around the outer circumferential face 165. Other embodiments can include only one or both features.

As discussed herein the elongated sections 110 provide the connection between the top section 125 and the base section 120. One or more connecting elements on an inner face of the elongated sections 110 can connect with a corresponding connection element 190 on the base section, such that the base section 120 and top section 125 are slidably movable relative to each other to form the open position and the closed position. The sections are connected such that inward pressure on the elongated sections 110 allow for the top section to be vertically raised and lowered relative to the base section 120. Without the inward pressure, the elongated section's connecting elements are configured to lock the top section into its current position.

In various embodiments, the elongated sections are configured to secure to the top section and base section into the closed position until inward pressure is applied to the elongated sections to disconnect the connection. The top section 125 can be pulled away from the base section 120 using the one or more raised portions 160 or one or more indentations 170 until the open position is reached. From this position, removal of the pressure can lock the device into the open position. Inward pressure on the elongated sections can similarly disconnect the connection between the sections and allow for the top and base sections to be slidably moved back to the closed position.

In some embodiments, manipulation and/or pressure of the elongated sections 110 is not necessary to cause the device to go from the open position to closed position. In some examples, a downward pressure on the top surface 145 can cause the top section 125 to slide downwards and ultimately lock in the closed position. The downward pressure may require a certain threshold force to cause the top section to move from the open position to the closed position. The threshold force can allow for a user to dispense and adequately apply the product using the upper face 145 and raised nubs 145 and allow the user to easily push the top section down into the closed position when application is complete. This manner increases ease and efficiency of application and closure, by removing the necessity of inward pressure on the elongated ears to place the device in the closed position and prevent additional dispersion of the product. It will be appreciated that any of a plurality of lock, attachments, and mechanisms can be applied to allow the present invention to transition between open and closed positions. The particular design and manner of transition can be adjusted based on the type of product, user comfort, intended use, and the like.

Moreover, in some embodiments a plurality of top sections can be interchangeable with one or more base sections. As discussed herein, top sections can include a plurality of designs on the top surface, including but not limited to varying shapes, sizes, and amounts of raised nubs 145. Top sections can comprise one or more of a variety of materials, including but not limited to plastics, polypropylene, and TPE. Various top sections can work differently with different products, and some may be more suitable for applying certain products than others. Accordingly, top sections may be interchanged depending on various considerations, including but not limited to the desired design, intended use, and type of product.

Figure 2:
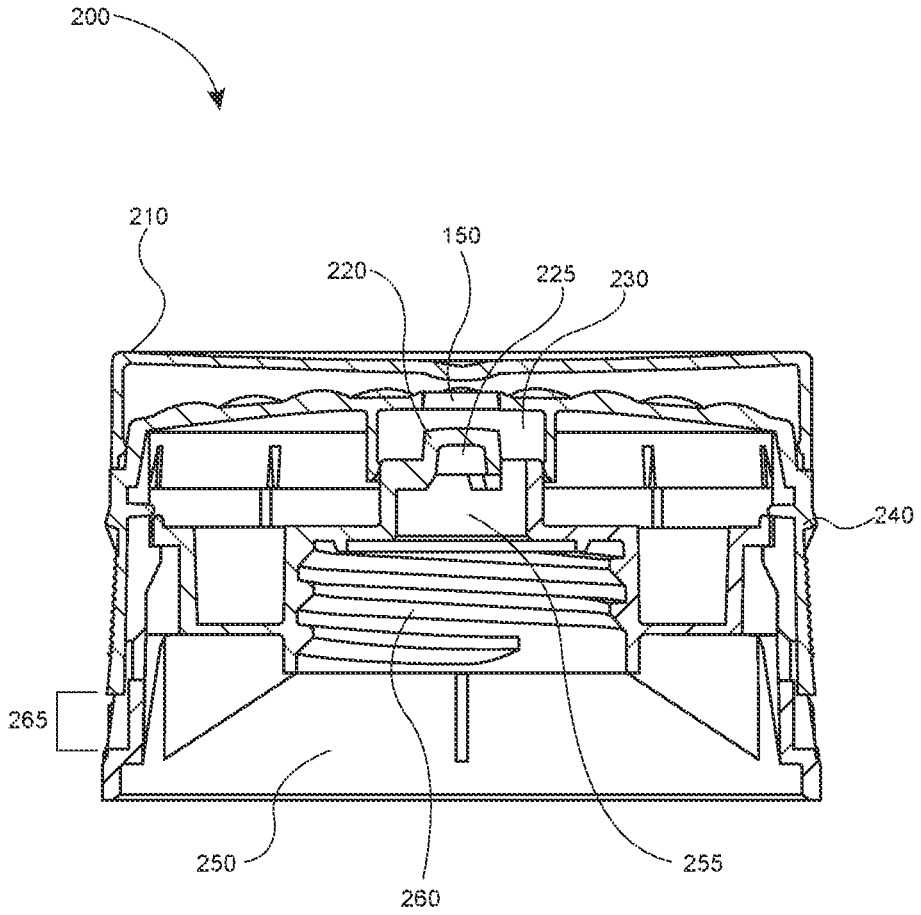
FIG. 2 illustrates a cross-sectional view of an applicator cap in a closed position, in accordance with embodiments discussed herein.

FIG. 2 illustrates a cross-sectional view of an applicator cap in the open position 200 in accordance with embodiments. The open position allows for flow of product from the container through the base and top section, out through the central opening 150. The closed position forms a seal such that product cannot be dispensed through the top section's central opening.

In the depicted example, a funnel section 250 can encompass an opening of a container (not pictured). A plurality of threads 260 can secure the applicator cap to the container. The base section and the top section mutually provide or block a pathway for the flow of product, based on their orientation in the open or closed position. As illustrated in FIG. 2, pathway 220 is formed when the device is in the open position, i.e., when the base section and top section are in an extended position and slidably separated 265 from each other. In the open position a seal 225 on the base section is separated from a correspondingly-fitted block section 230 on the top section, which allows product to be dispensed from an opening section 255 at the mouth of the funnel section 250 of the base section, and through the central opening. In embodiments, as discussed herein, a connecting element 240 can lock the downward facing elongated ears in a fixed position relative to the base section.

As discussed above, in the closed position, the downward-facing elongated sections also secure the top and base sections together via connecting element 240 which maintain a secure orientation between the two sections and prevent the sections from slidably transitioning to the open position. In the closed position, the block section 230 fits against the opening section 255 on the base section such that seal 225 seals the central opening and reduces pathway 220 to prevent any product from exiting the opening section 255. The block section 230, seal 225, and central opening 155 are fitted such that the block section surrounds the seal 225 and encloses the opening section 255 from dispensing product.

In embodiments, the block section 230 is a cylindrical section with an inner portion that corresponds to and fits with the seal 225. The length of the block section 230 can be at least the length of pathway 220. In embodiments, the width of the cylindrical section corresponds to a width of the pathway 220 such that in the closed position, the cylindrical section reduces pathway 220 to prevent product flow: In this manner, the closed position prevents any leakage of the product. In the open position, pathway 220 is clear and enables product to flow from opening section 255, past the seal 225, and through the central opening.

Seal 225 extends from a central position from the top face of the opening section and fits with block section 230 to close pathway 220 and prevent product from flowing through central opening 150.

Figure 3B:
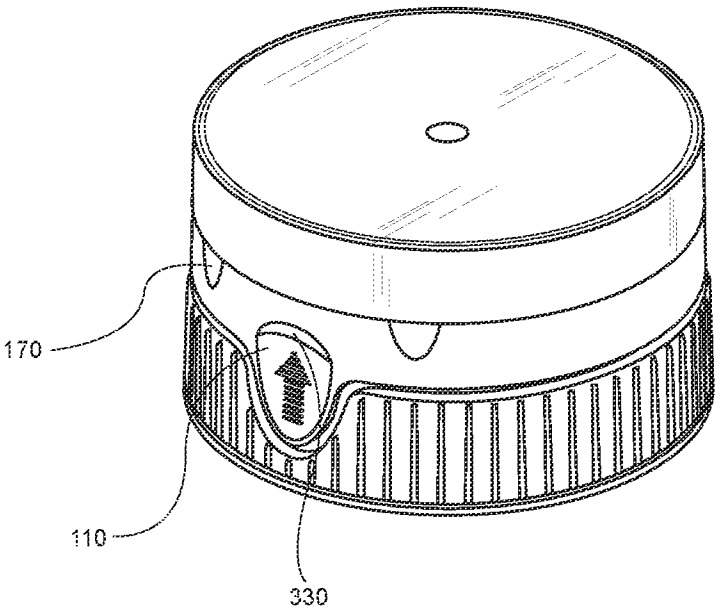
FIG. 3B illustrates the applicator cap of FIG. 3A with a cap over the top surface.
Figure 3A:
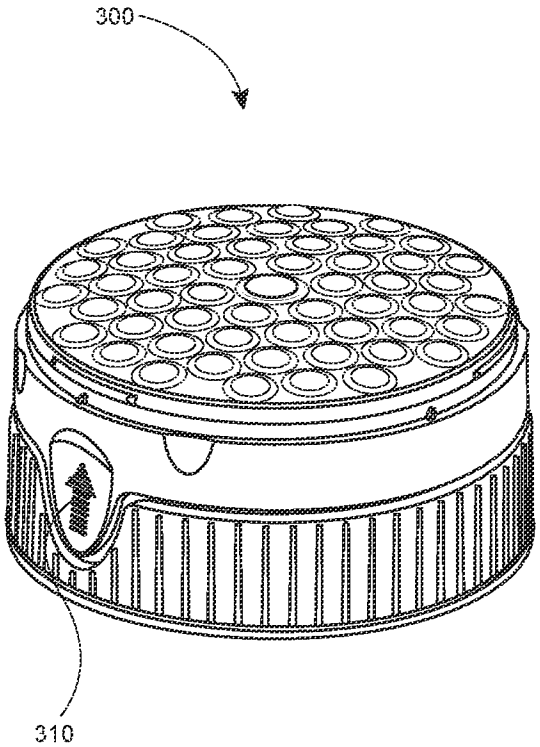
FIG. 3A illustrates another example of applicator cap in accordance with embodiments discussed herein.

FIG. 3A illustrates another example of the applicator cap, in accordance with embodiments discussed herein. FIG. 3B illustrates the applicator cap of FIG. 3A, with a cap covering the top surface. The applicator cap 300 includes at least two elongated sections 110 as discussed above, which assist with transitioning the applicator cap between the open and the closed position. The elongated sections 110 can be marked with at least one indicator 310, such as an arrow or similar design, to indicate a direction for users to operate the applicator cap. For example, an arrow can depict where a user should grasp and/or direct where a user should pull a section, e.g., during a transition. It will be appreciated that one or more indicators 310 can be placed at various locations and/or sections on the applicator cap. For example, the indicator can be placed on the elongated sections 110, as illustrated, and could also reside on an outer edge of the top section, or other location.

The elongated sections 110 can further include a concave shape to provide a finger groove to assist with grip. In embodiments, an upper lip 330 can further assist with grip and efficiency with the transition between positions. The applicator cap can also provide one or more indentations 170 that can, for example, assist with grip and movement in the opposite direction, e.g., from the open to the closed position. The indentations can be scalloped indentations, or take on a plurality of other shapes and forms, depending on the desired design, functionality, and aesthetics.

Figure 4A:
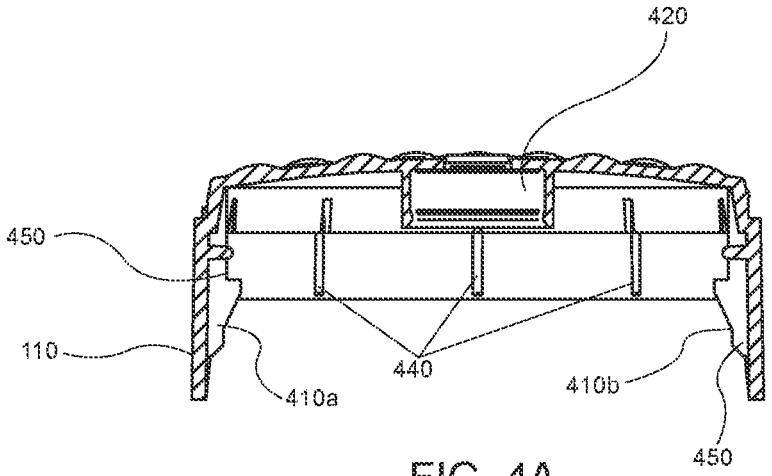
FIG. 4A illustrates a cross-sectional view of the top section of an applicator cap, in accordance with embodiments discussed herein.
Figure 4B:
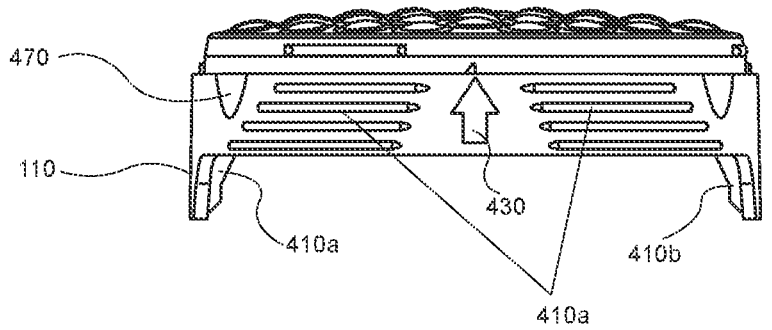
FIG. 4B illustrates a side view of the top section, in accordance with embodiments discussed herein.

FIG. 4A illustrates a cross-sectional view of the top section of an applicator cap, and FIG. 4B illustrates a side view of the top section, in accordance with embodiments. As illustrated in FIG. 4A, the top section can include a raised coupling element 410*a*, 410*b*, on an inner face of each elongated section 110. Each raised coupling element can be include a tapered shape wherein a horizontal top edge 450 extends from the inner face and secures to the base section, to prevent the top section from movement in the closed position. When inward pressure is applied on the elongated sections 110, the top edge 450 is separated from contact with the base section and allows for the slidable movement between the open and closed positions. The shorter, tapered bottom edge 455 does not interfere with the base section during transitions between positions. The top section can further include a plurality of raised guides 440 on an inner circumferential face of the top section. The raised guides 440 can contact the base section and promote consistent movement during transitions and structural integrity. FIG. 4A further illustrates an external face 420 of the block section, which assists in opening and closing a pathway 220 for the product in the respective open and closed positions of the applicator device.

FIG. 4B illustrates a side view of the top section, in accordance with embodiments. The downward facing elongated sections 110 and connecting element 410*a*. 410*b* extend below the circumferential side face of the top section. As discussed with respect to FIGS. 3A and 3B, an indicator 430, such as an arrow; can be placed on an external face of the top section to indicate where a user should grasp and/or a direction of movement, e.g., during a transition. In examples, an arrow or similar indicator mark, can be placed between a plurality of grips 460 arranged on the outer face. In embodiments, the top section can include one or more of an indicator 430, grips 460, and indentations 470. Such features can be provided in any order and in any of a variety of shapes and structures to assist with grip and ease of use.

Figure 5A:
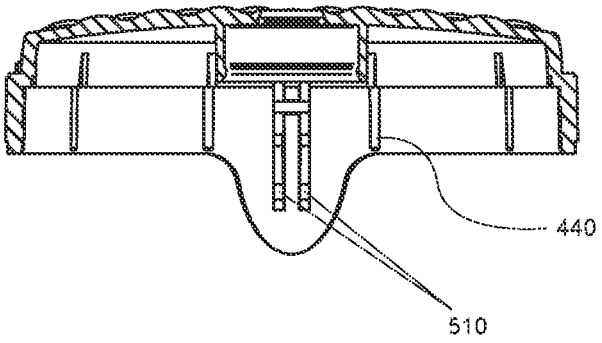
FIG. 5A illustrates another cross-sectional side view of the top section, in accordance with embodiments discussed herein.

FIG. 5A illustrates another cross-sectional side view of the top section. The side view directly faces the elongated sections and illustrates the connecting elements 510, e.g., two connecting elements, affixed to an inner face of each elongated sections. In embodiments, there can be a plurality of raised connecting elements, which assist in securing the top section and the base section. The connecting elements 510 can further serve as a guide, along with raised guides 440 so that vertical movement between the open and closed positions are maintained with minimal lateral movement and instability.

Figure 5B:
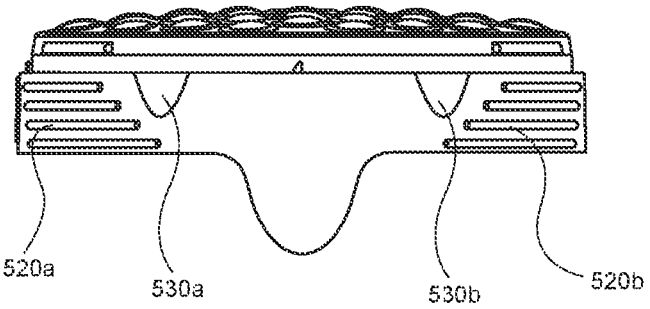
FIG. 5B illustrates a side view of the top section, in accordance with embodiments discussed herein.
Figure 6:
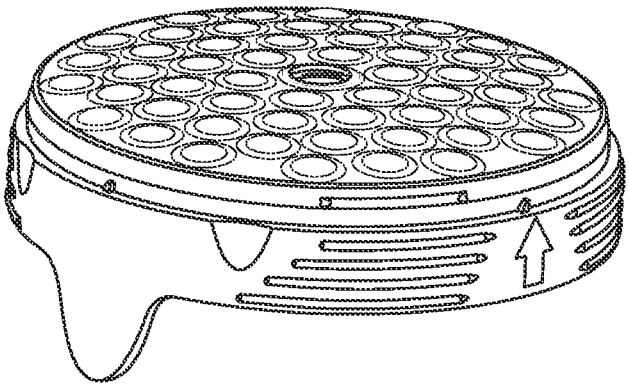
FIG. 6 illustrates a perspective view of the top section in accordance with embodiments discussed herein.

FIG. 5B illustrates a side view of the top section illustrated in FIG. 5A. Similar to other embodiments discussed herein, a plurality of raised ridges, can provide additional grip assistance for manipulating the applicator cap. In the present example, raised ridges 520*a*, 520*b* can be placed on opposite sides of an external circumferential face of the top section, between the elongated ears. The raised ridges can include at least four horizontal lines. In various embodiments, the ridges can be staggered to form a diagonal slope, and can include ridges that decrease in length from a bottom edge to a top edge. A plurality of scalloped indentations 530*a*, 530*b* can be placed adjacent to the raised ridges 520*a*, 520*b*, on one or both sides of the elongated section. As discussed herein, the orientation, shape, and position of these features can include any of a plurality of designs. FIG. 6 illustrates a perspective view of the top section in accordance with embodiments discussed herein.

Figure 7:
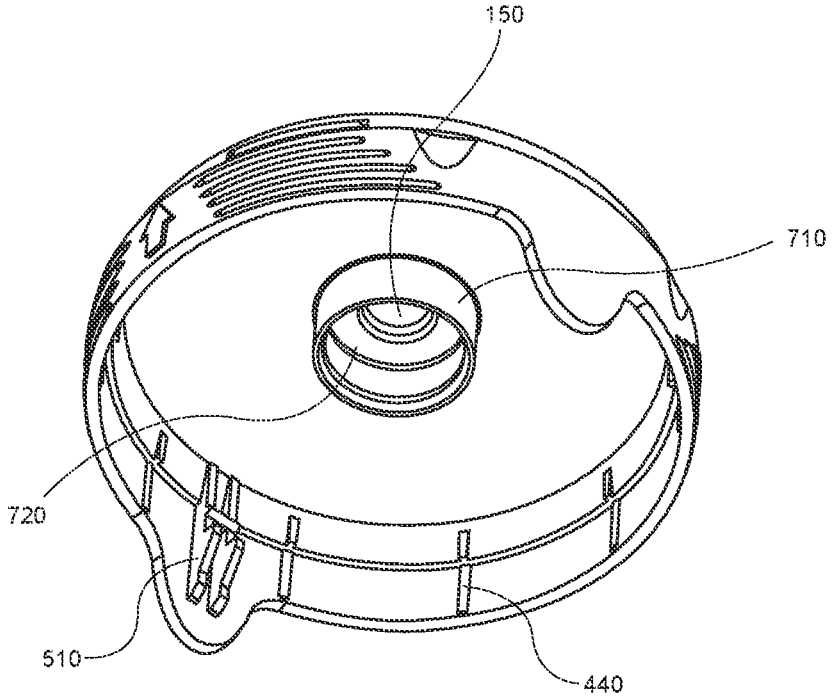
FIG. 7 illustrates a bottom perspective view of a top section in accordance with embodiments discussed herein.

FIG. 7 illustrates a bottom perspective view of a top section of an applicator cap in accordance with embodiments discussed herein. The raised connecting elements 510 on an inner face of the elongated sections can include a hook-like shape, as discussed herein. The raised connection elements can secure to a corresponding connecting element on the base section to prevent movement during the open and closed positions and enable the slidable transitions when inward pressure is applied to the elongated sections.

The downward-extending outer cylindrical section 710 forms part of the block section 230, which creates a flow pathway 220 for the product in the open position, and assists with preventing flow of product through the central opening 150 when the applicator cap is in the closed position. The outer cylindrical section 710 can surround an opening in the base section, through which product can travel through from its container. In embodiments, the top section can include an inner cylindrical section 720 within the outer cylindrical section which tapers the pathway for the product and directs it towards central opening 150. The inner and outer cylindrical sections work together to seal off the flow pathway 220 in the closed position and provide the flow pathway in the open position. Accordingly, it will be appreciated that a plurality of physical features and mechanisms can be implemented to seal off the flow pathway in the closed position and enable flow of the product from the container through the central opening when the applicator cap is in the open position.

Figure 8A:
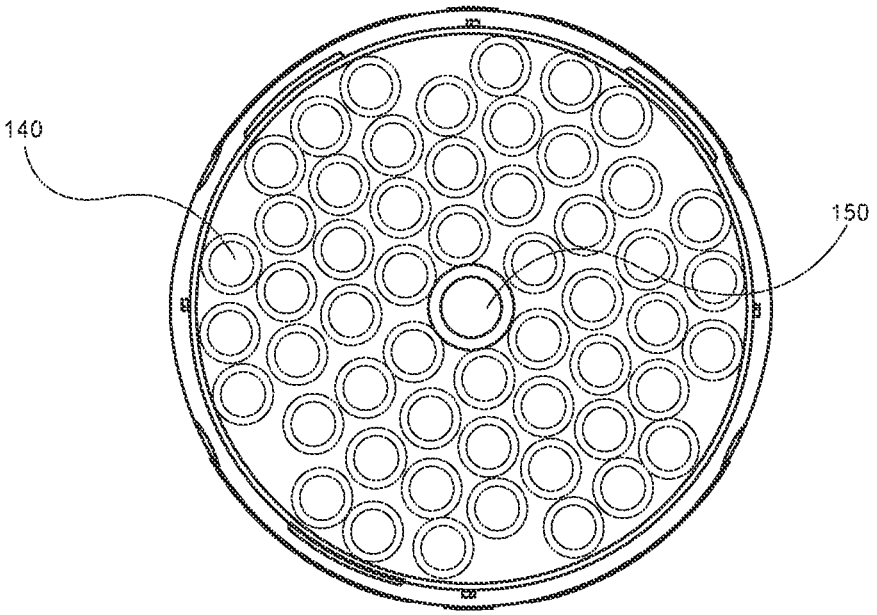
FIG. 8A illustrates a top view of the present invention, in accordance with embodiments discussed herein.
Figure 8B:
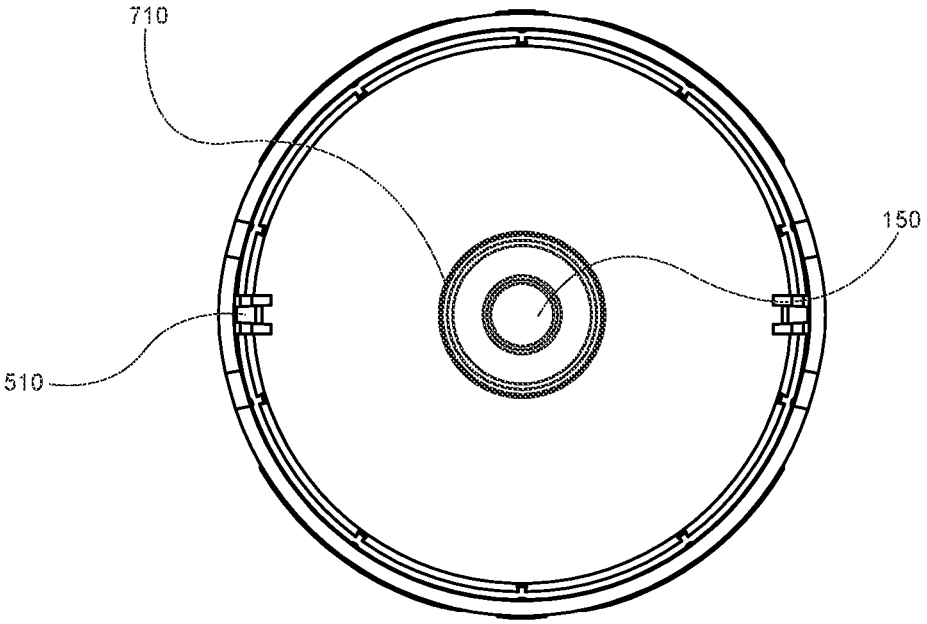
FIG. 8B illustrates a bottom view of the top section, in accordance with embodiments discussed herein.

FIG. 8A illustrates a top view of the present invention, in accordance with embodiments discussed herein. A plurality of raised nubs can be placed on the top section, around a central opening 150 through which product can be dispensed. In embodiments, the raised nubs include a circular shape. In various embodiments, the top of the raised nubs is smaller in diameter than the base of the raised nub. The raised nubs can be bumps, ridges, ovals, spikes, and any include any of a plurality of shapes, orientations, and placements in accordance with embodiments discussed herein. The raised nubs provide an efficient, mess-free method for applying dispensed product onto a desired area. The raised nubs can be appropriately shaped to help fully apply the product to the desired surface. For example, product applied to skin may be rubbed into the skin using the raised nubs 140 on the top surface of the applicator cap. The shape of the raised nubs helps to ensure the product is efficiently spread and/or maximally absorbed, in order to reduce waste and excess product, on one or both of the top surface and the skin. FIG. 8B illustrates a bottom view of the top section. The cylindrical section 710 surrounds the central opening 150, and the plurality of raised connecting elements extend inwardly.

Figure 9:
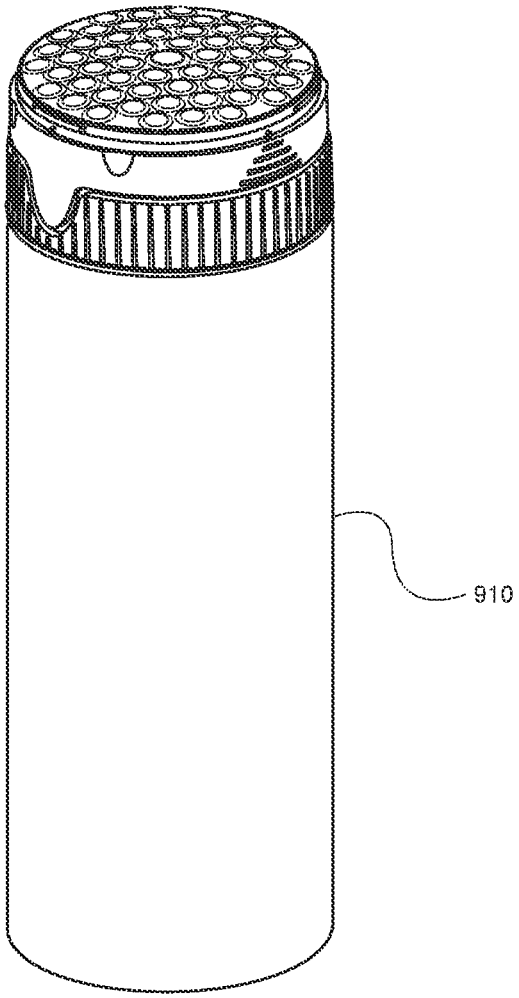
FIG. 9 illustrates an example of an applicator cap connected to a container, accordance with embodiments discussed herein.

FIG. 9 illustrates an example of an applicator cap connected to a container 910. As discussed herein, the applicator cap, in particular the base section, can include a plurality of threads to attach to a container containing product. In some embodiments, the applicator cap can be optionally, removably connected to a container 910. In other embodiments, the applicator cap and container 910 can form a single device.

In various embodiments, the container 910 can take any of a plurality of forms, including but not limited to a cylinder, a tube, a squeezable container, and the like. The container can also hold any of plurality of products such as a topical product. The product can be a lotion, a cream, a medicine, and/or liquid, although it will be appreciated that the product need not be limited to those examples.

As discussed herein, the base section can include a plurality of features to assist with grip and manipulation. In embodiments, the indentation can be a half-moon or crescent shaped indentation. The indentation 1010 can be position between the elongated sections, such as halfway between the elongated sections. There can be one, two, or more indentations at various positions on the base section, such as a top or bottom half of a lateral face of the base section. The indentations can further comprise a variety of shapes, sizes, and designs on the base section.

In embodiments, any indentation 1010 and/or grip feature on the base section can assist with transitioning the applicator between the open and closed positions. For example, the indentation 1010 can provide an indication for a grip position and/or assist in directing the user where and how to manipulate the applicator cap to transition between positions. Indentation 1010 can be placed below an indicator, such as an arrow; a direction, and the like. In examples the indicator 430 and indentation 1010 can direct users to pull up at a certain position and grip the applicator cap at a certain area during the transition. As noted herein, it will be appreciated that any indentations and/or indicators are not limited to the pictured designs, and various designs, positions, shapes, and features can be implemented in accordance with embodiments discussed herein.

The open top surface 1110 through which product can flow in the open position can include a plurality of arms 1115, which connect a rim of the top surface of the opening section 255 to the seal 225. As discussed herein, when the applicator cap is in the open position, product can flow through the opening section 255 and the central opening 150 of the top section. It will be appreciated that the opening section 255 can include a plurality of designs to enable product to flow through the base section. For example, the open top surface can comprise one, two, three or more arms connecting to seal 225. In other embodiments, the seal 225 need not be connected to the opening section 225.

In embodiments, the base section further includes a raised section 1140 on which the opening section 255 and its related features are placed. The raised section 1140 can serve to narrow the product flow pathway, and aid in providing a controlled flow through the applicator cap. It will be appreciated that the raised section 1140 can include a cylindrical shape, as illustrated, and any of a plurality of shapes in accordance with embodiments. Moreover, the raised section 1140 can be surrounded by an outer wall 1120. The outer wall can assist with stability and integrity of the applicator cap when combined with the top section, and during transitions between the open and closed positions. The outer wall 1120 can further prevent dirt, debris, dust, and other unwanted objects from damaging the opening section 255, blocking the open top surface 1110, and/or otherwise impeding product flow. In embodiments, the outer wall 1120 has a smaller diameter than a bottom portion 1150 of the base section.

The base section can include a plurality of threads for attaching the applicator cap to a container and/or directing product flow from the container through the applicator cap. As discussed herein, threads 260 can assist in securing the applicator cap to a container. In particular, threads 260 can secure an opening section, e.g., mouth, of a container containing product. As such, any flowing product is directed only through the opening 255. A plurality of outer threads 1130 can be provided to additionally attach to a container, e.g., a container with a plurality of threads, and depending on the container's shape, size, opening, orientation, and the like. In an example, outer threads 1130 can secure to a container, and inner threads 260 can attach to an opening of the container. In some embodiments, one or both sets of threads 260, 1130 are utilized. For example, a container may only attach to inner threads 260 to be secured to the applicator cap, and dispense product in accordance with the methods and embodiments discussed herein.

While the invention has been described and illustrated herein by references to various specific materials, it is understood that the invention is not restricted to the combinations of material and procedures selected for that purpose. Numerous variations of such details can be implied as will be appreciated by those skilled in the art. It is intended that the specification and examples be considered as exemplary, only, with the true scope and spirit of the invention being indicated by the following claims.

Provided here are illustrative embodiments of the disclosed technology. These embodiments are illustrative only and do not limit the scope of the present disclosure or of the claims attached.

Embodiment 1. An applicator cap for dispensing a product, comprising:

a top section comprising an upper face and at least two elongated sections extending downward from the upper face, wherein the upper face comprises a plurality of raised nubs around a central opening for dispensing the product, and the at least two elongated sections comprise a raised coupling element on an internal face; and a base section connected to the top portion via corresponding coupling elements secured to the raised coupling element on the at least two elongated sections, and being slidably movable relative to the top section to form an open position and a closed position, wherein the base section comprises an internal thread to attach to a container containing the product, and a cylindrical tube to receive the product from the container, wherein in the open position, the cylindrical tube and the central opening form a pathway for dispersion of the product, and wherein in the closed position, the cylindrical tube and central opening form a seal to prevent dispersion of the product.

Embodiment 2. The applicator cap of embodiment 1, wherein the product is one or more of a cream, a lotion, a medicine, a liquid, and a topical product.

Embodiment 3. The applicator cap of embodiment 1 or 2, wherein the top section is slidably movable between the open position and the closed position when inward pressure is applied to the at least two elongated sections.

Embodiment 4. The applicator cap of any one of embodiments 1-4, wherein there are at least 50 raised nubs.

Embodiment 5. The applicator cap of any one of embodiments 1-4, further comprising a plurality of indentations on an external side face of the top section.

Embodiment 6. The applicator cap of any one of embodiments 1-5, further comprising at least one set of raised ribs on an external side face of the top section.

Embodiment 7. The applicator cap of embodiment 6, wherein the at least one set of raised ribs are placed between each of the at least two elongated sections.

Embodiment 8. The applicator cap of any one of embodiments 1-7, wherein the container is at least one of a tube, a cylinder, and a squeezable container.

Embodiment 9. The applicator cap of any one of embodiments 1-8, further comprising a cap removably connected to the top portion and configured to seal the upper face.

Embodiment 10. The applicator cap of any one of embodiments 1-9, further comprising a plurality of ridges on an external face of the base section.

Embodiment 11. A container for dispensing a product, comprising:

a tube containing the product; and an applicator cap secured to the tube, comprising:

a top section comprising an upper face and at least two elongated sections extending downward from the upper face, wherein the upper face comprises a plurality of raised nubs around a central opening for dispensing the product, and the at least two elongated sections comprise a raised coupling element on an internal face; and a base section connected to the top portion via corresponding coupling elements secured to the raised coupling element on the at least two elongated sections, and being slidably movable relative to the top section to form an open position and a closed position, wherein the base section comprises an internal thread to attach to the tube, and a cylindrical tube to receive the product from the container, wherein in the open position, the cylindrical tube and the central opening form a pathway for dispersion of the product, and wherein in the closed position, the cylindrical tube and central opening form a seal to prevent dispersion of the product.

Embodiment 12. The container of embodiment 11, wherein the product is one or more of a cream, a lotion, a medicine, a liquid, and a topical product.

Embodiment 13. The container of embodiment 11 or 12, wherein the top section is slidably movable between the open position and the closed position when inward pressure is applied to the at least two elongated sections.

Embodiment 14. The container of any one of embodiments 12-13, further comprising a plurality of indentations on an external side face of the top section.

Embodiment 15. The container of any one of embodiments 12-14, further comprising at least one set of raised ribs on an external side face of the top section.

Embodiment 16. The container of any one of embodiments 12-15, wherein the at least one set of raised ribs are placed between each of the at least two elongated sections.

Embodiment 17. The container of any one of embodiments 12-16, further comprising a cap removably connected to the top portion and configured to seal the upper face.

Embodiment 18. The container of any one of embodiments 12-17, further comprising a plurality of ridges on an external face of the base section.

Embodiment 19. The container of any one of embodiments 12-18, wherein the applicator cap is removably secured to the tube.

Embodiment 20. An applicator cap for dispensing a product, comprising:

a top section comprising an upper face and at least two elongated sections extending downward from the upper face, wherein the upper face comprises a plurality of raised nubs around a central opening for dispensing the product, and the at least two elongated sections comprise a raised coupling element on an internal face.

What is claimed:

1. An applicator cap for dispensing a product, comprising:

a top section comprising an upper face and at least two elongated sections extending downward from the upper face, wherein the upper face comprises a plurality of raised nubs around a central opening for dispensing the product, and the at least two elongated sections comprise a raised coupling element on an internal face; and a base section connected to the top section via corresponding coupling elements secured to the raised coupling element on the at least two elongated sections, and being slidably movable relative to the top section to form an open position and a closed position, wherein the base section comprises an internal thread to attach to a container containing the product, and a cylindrical tube to receive the product from the container, wherein in the open position, the cylindrical tube and the central opening form a pathway for dispersion of the product, and wherein in the closed position, the cylindrical tube and central opening form a seal to prevent dispersion of the product.

2. The applicator cap of claim 1, wherein the product is one or more of a cream, a lotion, a medicine, a liquid, and a topical product.

3. The applicator cap of claim 1, wherein the top section is slidably movable between the open position and the closed position when inward pressure is applied to the at least two elongated sections.

4. The applicator cap of claim 1, wherein there are at least 50 raised nubs.

5. The applicator cap of claim 1, further comprising a plurality of indentations on an external side face of the top section.

6. The applicator cap of claim 1, further comprising at least one set of raised ribs on an external side face of the top section.

7. The applicator cap of claim 6, wherein the at least one set of raised ribs are placed between each of the at least two elongated sections.

8. The applicator cap of claim 1, wherein the container is at least one of a tube, a cylinder, and a squeezable container.

9. The applicator cap of claim 1, further comprising a cap removably connected to the top section and configured to seal the upper face.

10. The applicator cap of claim 1, further comprising a plurality of ridges on an external face of the base section.

11. A container for dispensing a product, comprising:

a tube containing the product; and an applicator cap secured to the tube, comprising:

a top section comprising an upper face and at least two elongated sections extending downward from the upper face, wherein the upper face comprises a plurality of raised nubs around a central opening for dispensing the product, and the at least two elongated sections comprise a raised coupling element on an internal face; and a base section connected to the top section via corresponding coupling elements secured to the raised coupling element on the at least two elongated sections, and being slidably movable relative to the top section to form an open position and a closed position, wherein the base section comprises an internal thread to attach to the tube, and a cylindrical tube to receive the product from the container, wherein in the open position, the cylindrical tube and the central opening form a pathway for dispersion of the product, and wherein in the closed position, the cylindrical tube and central opening form a seal to prevent dispersion of the product.

12. The container of claim 11, wherein the product is one or more of a cream, a lotion, a medicine, a liquid, and a topical product.

13. The container of claim 11, wherein the top section is slidably movable between the open position and the closed position when inward pressure is applied to the at least two elongated sections.

14. The container of claim 11, further comprising a plurality of indentations on an external side face of the top section.

15. The container of claim 11, further comprising at least one set of raised ribs on an external side face of the top section.

16. The container of claim 15, wherein the at least one set of raised ribs are placed between each of the at least two elongated sections.

17. The container of claim 11, further comprising a cap removably connected to the top section and configured to seal the upper face.

18. The container of claim 11, further comprising a plurality of ridges on an external face of the base section.

19. The container of claim 11, wherein the applicator cap is removably secured to the tube.

20. An applicator cap for dispensing a product, comprising:

a top section comprising an upper face and at least two elongated sections extending downward from the upper face, wherein the upper face comprises a plurality of raised nubs around a central opening for dispensing the product, and the at least two elongated sections comprise a raised coupling element on an internal face.

* * * * *